United States Patent [19]

Clague

[11] Patent Number: 4,479,416

[45] Date of Patent: Oct. 30, 1984

[54] APPARATUS AND METHOD FOR TRANSCRIBING MUSIC

[76] Inventor: Kevin L. Clague, 1700 Civic Center Dr., #510, Santa Clara, Calif. 95050

[21] Appl. No.: 526,203

[22] Filed: Aug. 25, 1983

[51] Int. Cl.[3] ..... G10G 3/04

[52] U.S. Cl. ..... 84/462; 84/477 R

[58] Field of Search ..... 84/454, 462, 470 R, 84/471 R, 477 R, DIG. 2, DIG. 6, DIG. 9, DIG. 18, DIG. 20; 381/38, 49, 118, 122

[56] References Cited

U.S. PATENT DOCUMENTS

| | | | |
|---|---|---|---|
| 3,647,929 | 3/1972 | Milde, Jr. | 84/1.01 |
| 3,926,088 | 12/1975 | Davis et al. | 84/462 |
| 4,028,985 | 6/1977 | Merritt | 84/454 |
| 4,104,949 | 8/1978 | Clark | 84/462 |
| 4,273,023 | 6/1981 | Mercer | 84/470 R |
| 4,377,961 | 3/1983 | Bode | 84/DIG. 18 |
| 4,392,409 | 7/1983 | Coad, Jr. et al. | 84/462 |

FOREIGN PATENT DOCUMENTS

| | | | |
|---|---|---|---|
| 2064851 | 6/1981 | United Kingdom | 84/462 |

*Primary Examiner*—William B. Perkey

*Attorney, Agent, or Firm*—Merchant, Gould, Smith, Edell, Welter & Schmidt

[57] ABSTRACT

A music transcription apparatus and method are shown which do not require the use of a special electronic keyboard. A microphone picks up the musical sounds which a pitch detector array breaks down into their component pitches. A data processing system then eliminates harmonics and transients, and selects the proper notes, rests and accidental signs to represent the music. The music is then displayed on a conventional music score.

9 Claims, 21 Drawing Figures

FIG. 1
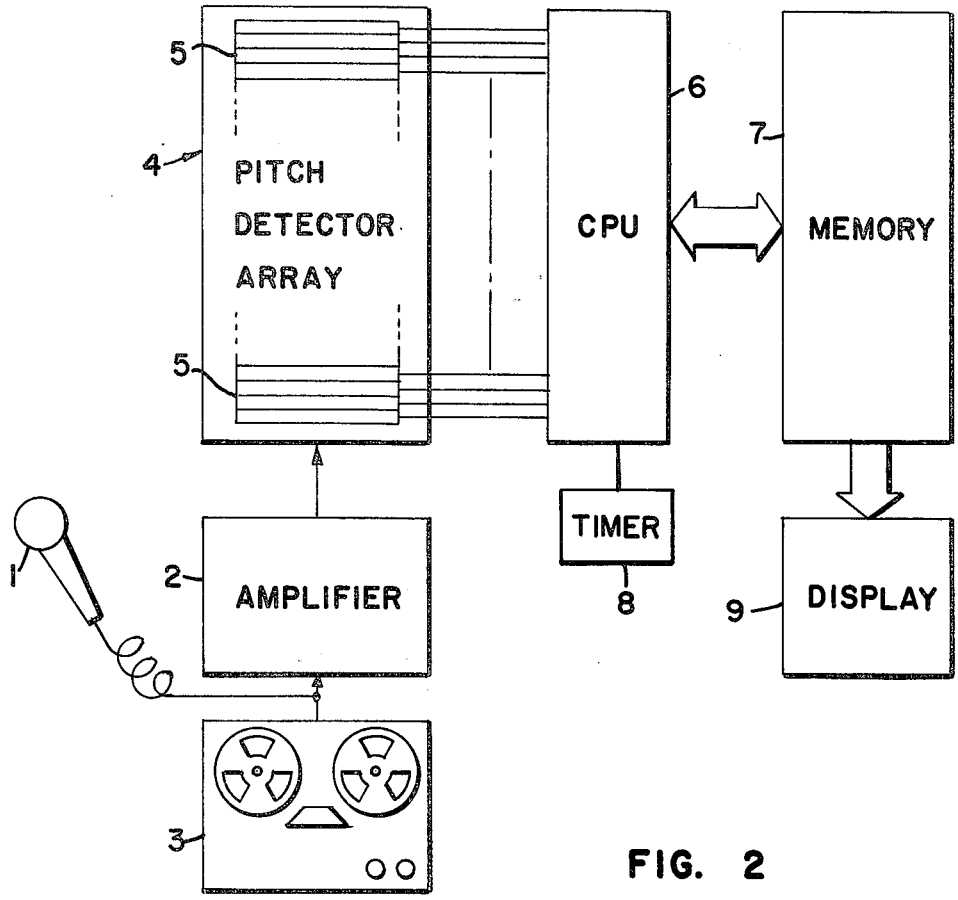
FIG. 20
| | | |
|---|---|---|
| C | | 1 |
| C# | D♭ | 0 |
| D | | 1 |
| D# | E♭ | 0 |
| E | | 1 |
| F | | 1 |
| F# | G♭ | 0 |
| G | | 1 |
| G# | A♭ | 0 |
| A | | 1 |
| A# | B♭ | 0 |
| B | | 1 |
| C | | 1 |
FIG. 2
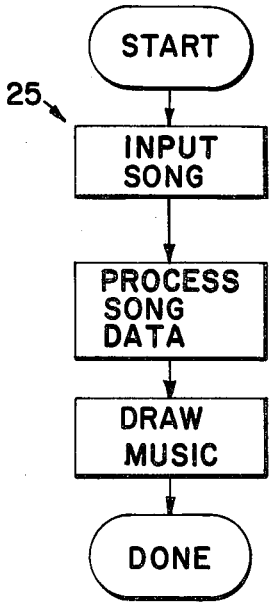

| PITCH | KEY F 1 | $B^b$ 2 | $E^b$ 3 | $A^b$ 4 | $D^b$ 5 | $G^b$ 6 |
|---|---|---|---|---|---|---|
| A | O | d | O | O | O | O |
| $B^b$ | – | – | – | – | – | – |
| B | O | O | O | O | O | – |
| C | – | – | – | – | – | O |
| $D^b$ | O | O | O | O | O | – |
| D | – | – | – | – | – | O |
| $E^b$ | O | O | O | O | O | – |
| E | – | – | – | – | – | O |
| F | O | O | O | O | O | O |
| $G^b$ | – | – | – | – | – | – |
| G | O | O | O | O | O | – |
| $A^b$ | – | – | – | – | – | O |
| A | O | O | O | O | O | – |
| $B^b$ | – | – | – | – | – | – |
| B | O | O | O | O | O | – |
| C | – | – | – | – | – | O |
| $D^b$ | O | O | O | O | O | – |
| D | – | – | – | – | – | O |
| $E^b$ | O | O | O | O | O | – |
| E | – | – | – | – | – | O |
| F | O | O | O | O | O | O |
| $G^b$ | – | – | – | – | – | – |
| G | O | O | O | O | O | – |
| $A^b$ | – | – | – | – | – | O |

| PITCH | KEY G 1 | D 2 | A 3 | E 4 | B 5 |
|---|---|---|---|---|---|
| A | – | – | – | – | O |
| A# | O | O | O | O | – |
| B | – | – | – | – | O |
| C | – | – | – | – | O |
| C# | O | O | O | O | – |
| D | – | – | – | – | O |
| D# | – | – | – | – | O |
| E | – | – | – | – | O |
| F | – | – | – | – | O |
| F# | O | O | O | O | – |
| G | – | – | – | – | O |
| G# | O | O | O | O | – |
| A | – | – | – | – | O |
| A# | O | O | O | O | – |
| B | – | – | – | – | O |
| C | – | – | – | – | O |
| C# | O | O | O | O | – |
| D | – | – | – | – | O |
| D# | – | – | – | – | O |
| E | – | – | – | – | O |
| F | – | – | – | – | O |
| F# | O | O | O | O | – |
| G | – | – | – | – | O |
| G# | O | O | O | O | – |

START

CALCULATE KEY TABLE I
110
109
KEY TABLE II = KEY TABLE I
111
YES
120
NO
MEASURE BAR ?
112
READ AN EVENT (P1,P2)
OUTPUT EVENT (P1, P2)
118
OUTPUT EVENT (P1, P2)
119
121
END OF SONG ?
YES
DONE
NO
113
P1= REST OR MEASURE BAR
YES
NO
117
OUTPUT ACCIDENTAL
114
DOES PITCH CAUSE AN ACCIDENTAL ?
NO
116
UPDATE KEY TABLE II
YES
DETERMINE ACCIDENTAL
115

| | | | | | | | |
|---|---|---|---|---|---|---|---|
| PITCH (133) | 51 | 51 | 53 | 51 | 51 | 53 | 51 |
| TIME (134) | 1 | 10 | 13 | 14 | 20 | 25 | 30 |
| DURATION | 6 | 3 | 1 | 3 | 5 | 2 | 7 |

| | | | | |
|---|---|---|---|---|
| PITCH | 51 | 51 | 51 | 51 |
| TIME | 0 | 10 | 20 | 31 |
| DURATION | 6 | 7 | 5 | 6 |

KEY OF C

KEY OF B

KEY OF B FLAT

APPARATUS AND METHOD FOR TRANSCRIBING MUSIC

FIELD OF THE INVENTION

This invention relates to an apparatus and method for transcribing music played on any of a wide variety of musical instruments. A graphical musical score representing the music played by the instrument is automatically produced.

BACKGROUND OF THE INVENTION

The traditional method of transcribing music is for the composer to play a few notes, stop and write them down, play a few more notes, stop and write those down, and so on for the rest of the piece. This can be very disruptive of the composing process and quite time consuming.

Attempts have been made in recent years to alleviate these problems through the use of electronics, both with and without the aid of a computer. In U.S. Pat. No. 4,104,949 (Clark), a keyboard was electronically connected to a typewriter which had been modified to print musical notation. Each time a key on the keyboard was struck, the corresponding key on the typewriter would strike the paper. In U.S. Pat. No. 3,926,088 (Davis, et al.), a special keyboard having electrical switches associated with each key was connected to a data processing system. The data processing system would analyze each note being played on the keyboard to determine its duration, select the proper note or notes to represent it, and print the results out on a conventional music scale.

These techniques have the extreme disadvantage that they require the use of a keyboard, and, in particular, a specially made keyboard connected to the system so that a standard piano would not be useable. While many musicians are familiar with the use of a piano, organ or other keyboard instrument, many others are not. To them, the Clark and Davis inventions are of little value.

These non-keyboard playing musicians also cannot easily modify the inventions disclosed by Clark and Davis. A conventional, non-electronic, musical instrument generates several different pitches, or harmonics, each time a note is played. These different pitches played together sound harmonious to the human ear, but if only a microphone, amplifier and pitch detector were substituted for the keyboards in the Clark or Davis inventions, the signals to be transcribed would include all of the different harmonics being played at any given time, not just the note intended to be played.

In the Clark and Davis inventions, the use of specially connected keyboards allowed the direct detection of what note was intended to be played. The note intended was clearly the note corresponding to the key being depressed. With a non-keyboard instrument, it may not be this simple. The sound generated by the instrument may fluctuate around the actual pitch intended to be played. Such fluctuations would normally be referred to as transients. These transients might be the result of the instrument being slightly out of tune, or due to minor movements in the fingers of the musician.

In addition, with a non-keyboard instrument, various pitches of very short duration, also called transients, will often sound when the transition is being made from one note to another, with or without the musician intending them to. This type of transient would not generally be found when using a keyboard instrument. Both types of transients are typically far too short in duration to be perceptible to the human ear, but they are quite long enough to be detectable by electronic systems.

A system designed to use exclusively keyboard instruments would normally not have allowed for the potential errors introduced by transients. While transients might be found in the sounds being produced, they would not occur on the keyboards themselves. Since Clark and Davis "read" the notes being played directly from the keyboard, no allowance for transients was necessary.

It is the purpose of the present invention to provide a music transcription device which does not require the use of a keyboard and to which the musical instrument being played need not be electronically connected. Music may then be directly transcribed when it is played on an instrument in the conventional manner.

SUMMARY OF THE INVENTION

To overcome these and other disadvantages of the previous systems, applicant has provided an apparatus and a method whereby an analog electrical signal representative of musical sounds, such as might be produced by a microphone, is received and its component pitches and pauses determined. All pitches other than the lowest pitch playing at a particular time are deleted, thus eliminating any harmonics. Transients which are merely fluctuations around a main pitch are replaced with the main pitch. The remaining transients are eliminated. The notes and rests of proper duration and position on a conventional music score to represent each remaining pitch or pause are determined, as well as the need for any accidental signs. Finally, the resulting notes, rests and accidental signs are graphically displayed, thus creating a transcription of the original music.

OVERVIEW OF THE INVENTION

According to the present invention, an incoming analog electrical signal representative of music, such as might be generated by a microphone or a tape recorder playing back previously recorded music, is broken down into all of its component pitches, including transients, fundamentals and harmonics, and stored as data in a data processing system.

Next, all harmonics are removed from the data. When a conventional, non-electronic monophonic musical instrument is played, the lowest pitch generated is normally the note intended to be played. All of the notes above that pitch would normally be harmonics. According to the present invention, harmonics are eliminated from the raw data stored in the data processing system by assuming that the lowest pitch being played at any one time is the note intended to be played and eliminating all other pitches playing at that time.

The next step is to remove the transients from the data. Since a transient is by definition a pitch or pause of short duration, all of the transients in the data may be located by finding all pitches and pauses lasting less than a particular period of time. These transients must then be separated into two groups, the first being those transients which are fluctuations around the main pitch, and the second being the balance of the transients. To do this, the pitch immediately preceding the transient is compared with a pitch promptly following the transient. This following pitch need not immediately follow the transient, there may be a short gap or even another transient between the particular transient and the following pitch, but it must follow the transient within a particular period of time. If the immediately preceding pitch and the promptly following pitch are the same, it is assumed that the transient is merely a fluctuation around a main pitch. The data is then adjusted to eliminate the transient and show the immediately preceding pitch playing continuously from the time it originally commenced to the time the promptly following pitch originally ceased.

All the transients other than those modified by this process are assumed to be transients which are not fluctuations around a particular pitch. They are also assumed to have been unintentional, and therefore eliminated from the data, being replaced by pauses, or absences of any pitch or frequency, so the timing of the remaining pitches stays the same.

After the harmonics and transients have been eliminated, the resulting data is analyzed to determine the proper notes and rests to represent it on a conventional music scale. The duration of each pitch is compared to a table of note durations. The note closest in duration to the pitch is selected to represent the pitch. The same is done for each pause, or absence of any pitch, with a table of rest durations.

Next, the system checks to see if any accidental signs are needed. There are twelve half-steps in each octave. A conventional music scale uses seven of them. When the composer wishes to play one of the five notes which are not in the particular scale, or key, in which the piece is being written, an accidental sign (♮,♭ or ♯) is inserted immediately before the note on the music score. For the balance of the measure, a note shown in that position represents the accidental note, unless it too is preceded by an accidental sign. At the beginning of the next measure, the score reverts to representing the original, or home, key. To check for accidentals, the system keeps track of the home key and the significance of each position on the score (the modified key). The system compares the note to be played to the modified key, and, when a note is to be played which is not in the modified key, the system inserts the appropriate accidental and changes the modified key. At the beginning of each measure, the modified key reverts to the home key.

The results of this note, rest and accidental sign analysis are then graphically displayed on a conventional music score, resulting in a transcription of the original music. This display can be either a temporary one, as on a CRT screen, or, if a hard copy is desired, can be printed out on paper.

In the preferred embodiment of the present invention, the data may be inspected at various steps along the way, so that the source of any errors may be easily detected.

BRIEF DESCRIPTION OF THE DRAWINGS

The objects, features and advantages of the present invention will become further apparent from consideration of the following detailed description presented in connection with the accompanying drawings in which:

FIG. 1, sheet 1, shows a general view of the connections of the equipment in the preferred embodiment of the present invention.

FIG. 2, sheet 1, is a flow chart showing the overall procedure used according to the present invention.

FIG. 20, sheet 1, is the key quantization table for the key of C.

DETAILED DESCRIPTION OF THE INVENTION

Figure 3:
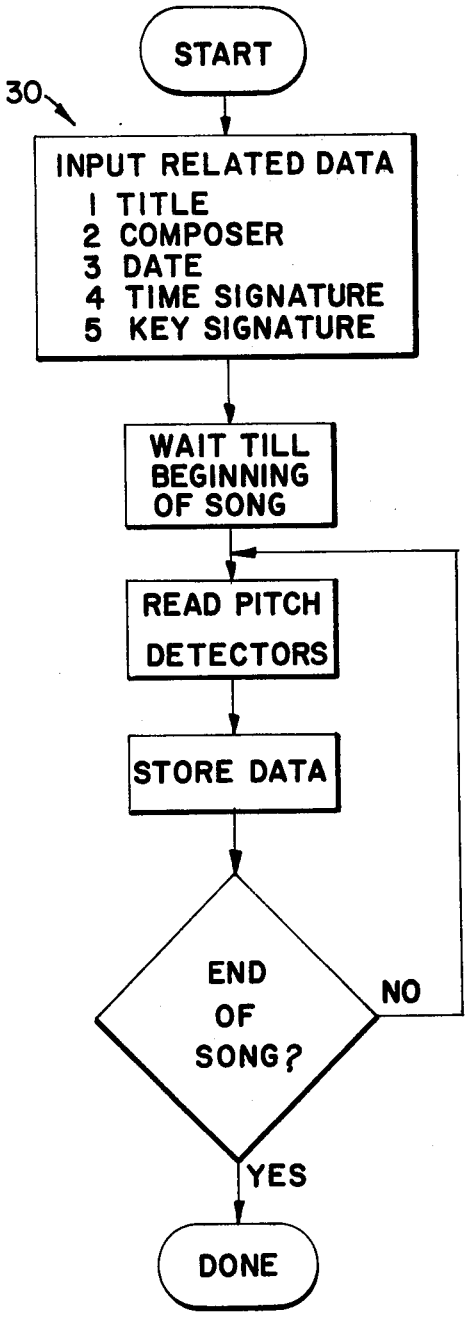
FIG. 3, sheet 2, is a detailed flow chart showing the procedure for inputting a piece of music.

The overall structure of the preferred embodiment of the present invention is represented in FIG. 1, sheet 1. A microphone 1 receives sound and generates an analog electrical signal representative of that sound. That signal is conveyed either to an amplifier 2 or to a tape recorder or other recording and playback device 3. If the signal is conveyed to the tape recorder 3, the tape recorder 3 is subsequently used to play back the signal to the amplifier 2. After having been amplified by the amplifier 2, the signal from the microphone 1 or tape recorder 3 is sent to a pitch detector array 4. The pitch detector array 4 is made up of a series of electronic pitch detectors 5, discussed in greater detail below. Each detector 5 is sensitive to a band of frequencies about each pitch. The total bandwidth for each detector extends from about 3% below the pitch detected to about 3% above it. The signal from the amplifier 2 is fed to each detector 5. When the detector 5 detects the presence of a signal in the range of frequencies to which it is sensitive, it produces a signal. When it detects a pause, or absence of the pitch or frequency to which it is sensitive, it produces no signal.

Figure 21:
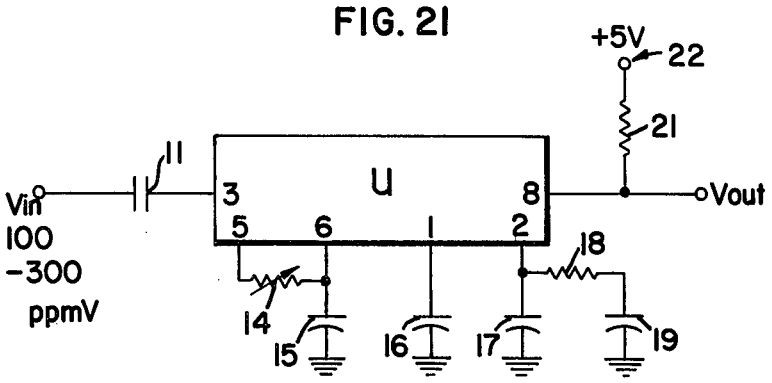
FIG. 21, sheet 14, is a schematic diagram of one detector element in the pitch detector array.

A more detailed schematic of an individual detector 5 in the pitch detector array 4 may be found in FIG. 21, sheet 14. Due to the extremely fine bandwidths being measured, a phase locked loop is used rather than a regular bandpass or notch filter. The schematic shown is based on the use of the commercially available chip LM567 (indicated as U in the drawing). The pin connections 1, 2, 3, 5, 6 and 8 for this chip are shown in the drawing. The voltage signal from the amplifier 2 comes in at $V_{in}$ at 100 to 300 ppmV. It passes through a capacitor 11 to pin 3 of the chip U. A variable resistor 14 is connected across pins 5 and 6. Pin 6 is also connected through a capacitor 15 to ground. Pin 1 is connected through a capacitor 16 to ground. Pin 2 is connected through a capacitor 7 to ground and through a resistor 18 and capacitor 19 connected in series to ground. Pin 8 is connected through a resistor 21 to a five volt power supply 22 and also connected to $V_{out}$. $V_{out}$ carries the output signal of the detector 5. The chip U outputs a signal at its pin 8 when it receives a signal with the proper frequency at its pin 3. The frequency needed at pin 3 to produce a signal at pin 8 may be adjusted by adjusting the variable resistor 14. It is to be understood that the schematic as shown is merely one embodiment of such a frequency detector, and any other frequency detector operating in the appropriate frequency ranges with the appropriate bandwidths would be equally useful.

Returning to FIG. 1, each detector 5 in the pitch detector array is connected to a signal processing analysis means. In the preferred embodiment shown, a programmed central processing unit, or CPU, 6, is used for this purpose. The CPU 6 can detect the condition of the $V_{out}$ signal coming from each detector 5 in the pitch detector array 4. The CPU 6 can also manipulate, alter, store and retrieve data from a data storage and retrieval device, or memory, 7, to which the CPU 6 is connected, and display information on a display device 9 to which the CPU 6 and memory 7 are also connected. The display device 9 may be a printer, CRT computer monitor, or any other suitable device, so long as it is capable of displaying a conventional music score. The CPU 6 is also connected to a timer 8 capable of generating pulses at regular intervals.

A block diagram 25 showing the overall operation of the apparatus as described is shown in FIG. 2, sheet 1. The song is first inputted into the system and converted to song data. The CPU then processes this song data. The resulting musical notation is then drawn, or transcribed, on the display device.

Turning to FIG. 3, sheet 2, a more detailed flow chart 30 of the procedure for inputting the song and converting it to song data is shown. Basic information such as the title of the piece, the composer, the date, the time signature in which the piece is written, and the key in which the piece is written are first read into the system. The system then waits for the beginning of a song. In order to synchronize the system's timing with the performer's, the first few measures should consist of repeated notes of fixed duration, such as quarter or eighth notes. The analog electrical signal representative of the music is fed to the amplifier 2 by the microphone 1 or the tape recorder 3, and thence to the pitch detector array 4. The CPU 6 reads across the incoming detector lines and perceives a digital signal representative of the pitches or frequencies being detected by the pitch detector array 4. The CPU 6 stores as data in the memory 7 a code representative of the digital signal at periodic intervals when it receives a pulse from the timer 8. Along with the code representing the digital signal, a code is stored representing the time after the commencement of the song at which this data was received and stored. The CPU 6 will then check to see if the song is over. If it is not, the CPU 6 will again read the signals from the pitch detector array 4 and store the appropriate data when it receives the next timer pulse. When the song is over, the data input phase is complete and the basic data has been stored.

Figure 4:
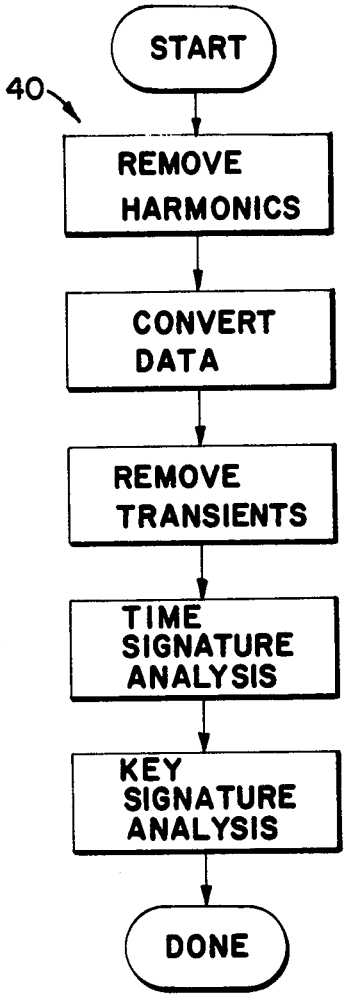
FIG. 4, sheet 2, is an intermediate level flow chart showing the processing done to the data between the time when it is received from the pitch detectors and the time it is ready to be displayed on the display device.

Once the data has been read into the system, it must be manipulated by the CPU 6 before it can be written on a conventional music score. FIG. 4, sheet 2, shows the broad steps 40 to be taken by the CPU 6 in modifying the data. In the preferred embodiment, the data may be inspected at any point in this procedure so that errors in processing may be readily detected. The CPU 6 will first remove all harmonics from the data. Next, the CPU 6 will convert the data to a pitch, time of pitch commencement and pitch duration format. The CPU 6 will then remove all transients from the data. It will then analyze the data to determine the appropriate notes and rests to represent each note, and then determine whether any accidental signs are necessary to properly represent the particular pitch given the key signature at the time that pitch occurs.

Figures 5, 18, 19:
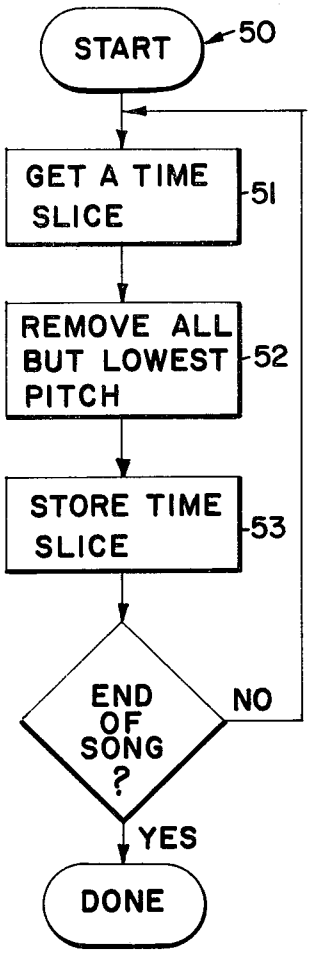
FIG. 5, sheet 3, is a detailed flow chart of the procedure for removing harmonics.
FIG. 18, sheet 3, is the key quantization table for the keys of G, D, A, E and B.
FIG. 19, sheet 3, is the key quantization table for the keys of F, B flat, E flat, A flat, D flat and G flat.

FIG. 5, sheet 3, shows a detailed flow chart 50 of the procedure for removing harmonics. As shown in logic block 51, the CPU 6 first reads from the memory 7 all of the frequencies which were playing at a particular time, also called a time slice. In logic block 52, the CPU 6 removes all but the lowest pitch playing at that particular time. In logic block 53, it stores this pitch in the memory 7 as the pitch playing at that time. This process is repeated for each time interval of data, or time slice, in the song.

Figure 6:
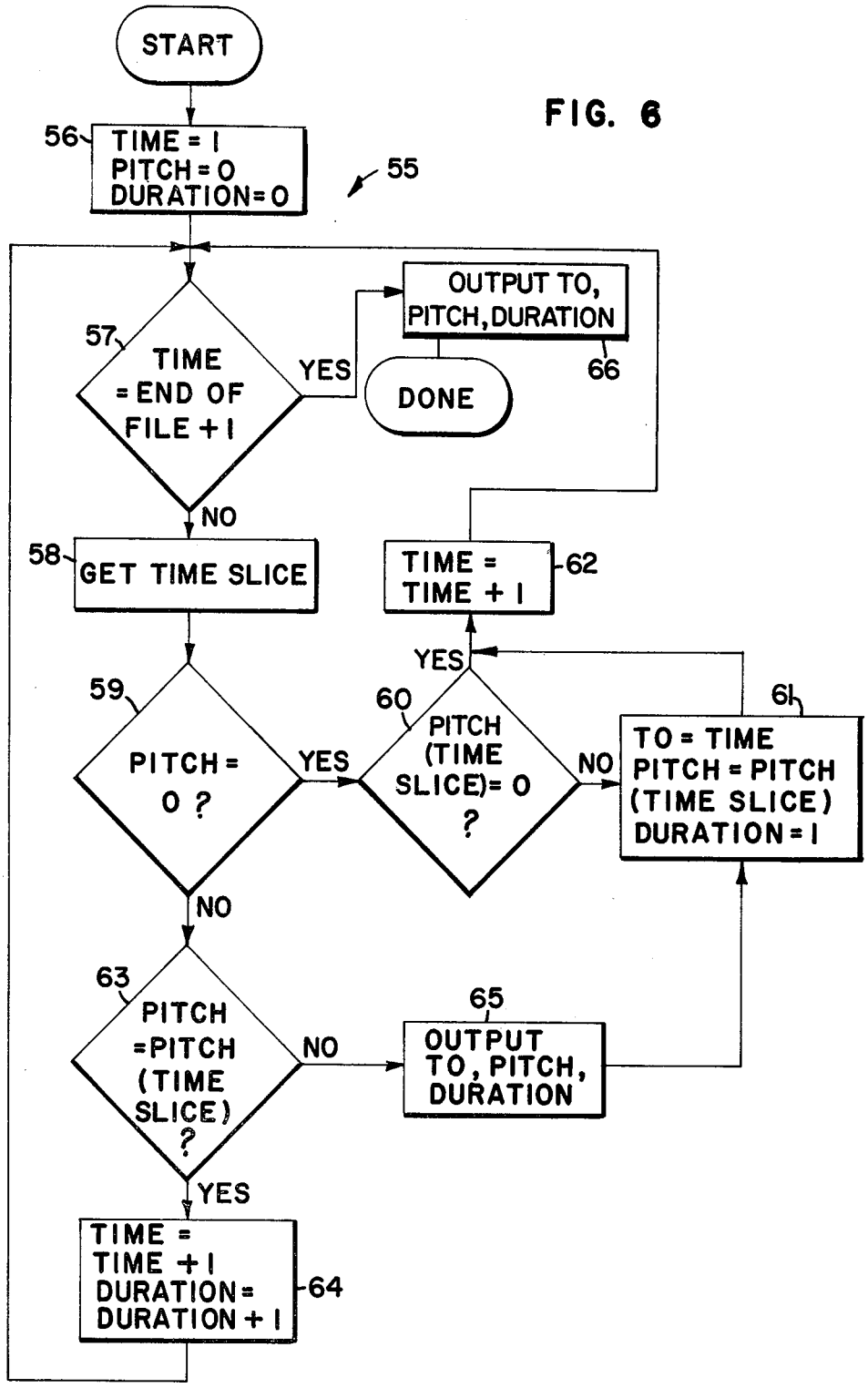
FIG. 6, sheet 4, is a detailed flow chart of the procedure for determining the duration of each pitch being played.

FIG. 6, sheet 4, shows a detailed flow chart 55 for the process of converting the data from a time/pitch format to a time of commencement/pitch/duration of pitch format. The CPU 6 starts in logic block 56 by establishing three registers, one each for time, pitch and duration. It sets time equal to one and the other two registers equal to zero. As shown in logic block 57, when the time register reaches one more than the number of time slices stored in the memory 7, the data conversion will be complete. Until that time, the CPU 6 will go to logic block 58 and get the time slice corresponding to the number in the time register. Going to logic block 59, the CPU 6 will check to see if the value of the pitch register is zero, i.e., represents a pause or absence of any pitch or frequency. If it is, as it clearly will be the first time the CPU 6 reaches logic block 59, the CPU 6 goes to logic block 60 and checks to see if the time slice contains a pitch or a pause. If it contains a pitch, i.e., it is not zero, the CPU 6 goes to logic block 61, sets a register TO equal to the time register, sets the pitch register equal to the pitch of the time slice and sets the duration register equal to one. After this, or immediately after logic block 60 if the time slice contains a pause, the CPU 6 increments the time register in logic block 62 and goes back to logic block 57. If in logic block 59 the CPU 6 finds that the pitch register is not equal to zero, it goes to logic block 63 and compares the pitch of the time slice with the pitch in the pitch register. If the two are the same, the CPU 6 goes to logic block 64 and increments the time and duration registers. It then goes back to logic block 57. If the pitch of the time slice is not the same as the pitch in the pitch register, the CPU 6 goes to logic block 65 and stores the values of the TO, pitch and duration registers in a file in the memory 7, thereby representing the song in a time of commencement-/pitch/duration format. The CPU 6 then goes to logic blocks 61, 62 and back to 59, appropriately resetting the TO, pitch, duration and time registers as it goes. In logic block 59, when the CPU 6 finally does hit the last time slice, it goes to logic block 66, outputs the final values of TO, pitch and duration and is finished with the data conversion.

Figure 7:
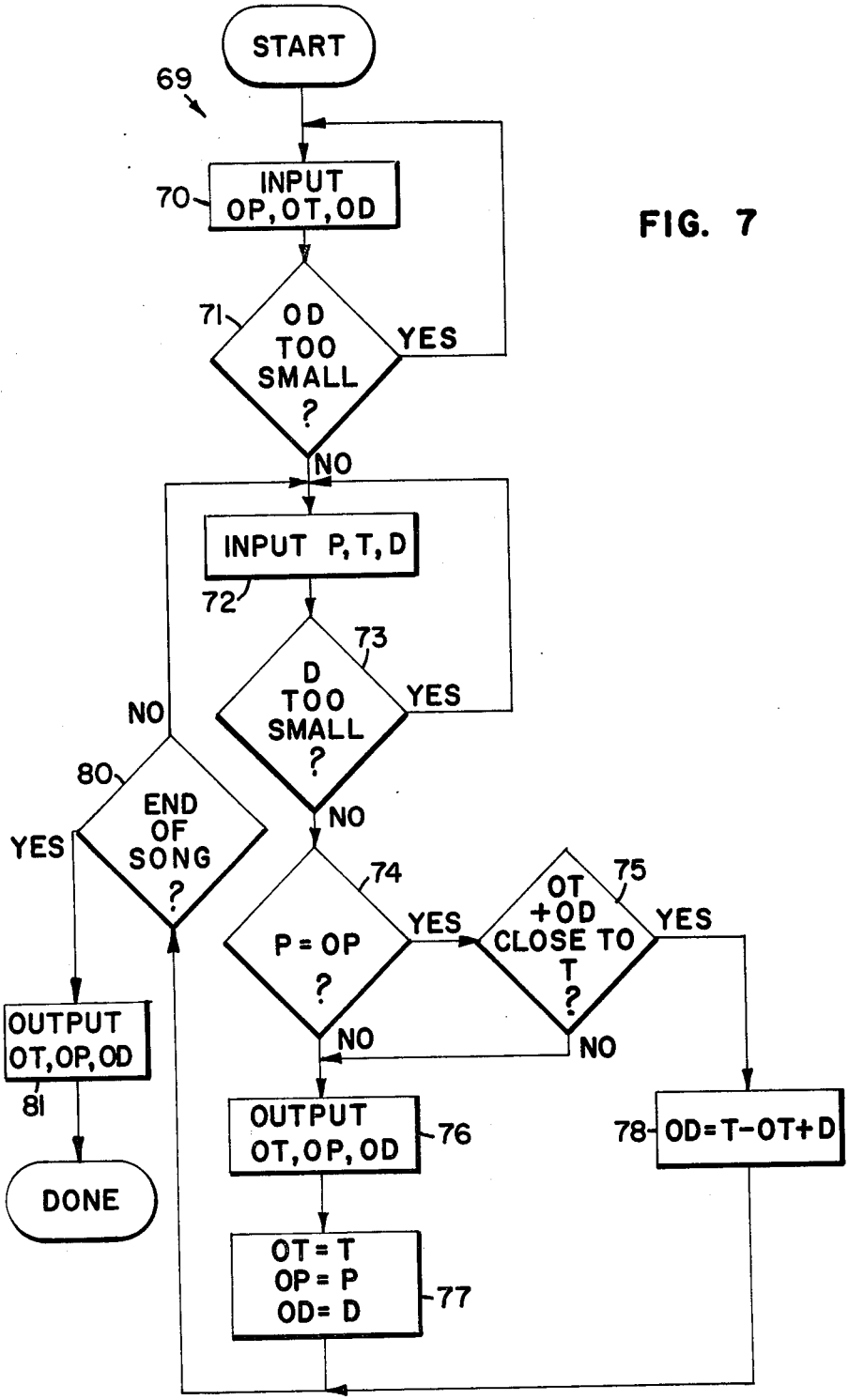
FIG. 7, sheet 5, is a detailed flow chart showing the procedure for transient elimination.

FIG. 7, sheet 5, shows a detailed flow chart 69 of the procedure for removing the transients from the data. The CPU 6 starts by reading in the first pitch, its time of commencement and its duration, represented in logic block 70 by the variables OP, OT, and OD, respectively. As shown in logic block 71, the CPU 6 then checks to see if the duration of the original pitch, OD, is less than a particular amount of time. If it is, the CPU 6 goes back and inputs the next unit of pitch/time of commencement/duration information. These then become the new values of OP, OT and OD, respectively. The CPU 6 repeats this process until it finds a pitch with a duration longer than the particular amount of time. As shown in logic block 72, it then inputs the next pitch-/time of commencement/duration unit, which is represented in logic block 72 by the variables P, T and D. As shown in logic block 73, if D is less than a particular duration, the CPU 6 goes back and inputs the next values of P, T and D. The CPU 6 repeats this process until it finds a set of values for P, T and D in which D is greater than a particular duration. As shown in logic block 74, the CPU 6 then compares P with OP. If the two are the same, the CPU 6 checks to see whether the time of commencement of the second pitch of sufficient duration, T, is closer than a particular amount of time to the time the first pitch would have ended, OT plus OD. If the time of commencement, T, is not close to the time the original pitch or frequency would have ended, OT plus OD, or if the pitch, P, was not the same as the original pitch, OP, the CPU 6 will store the values of OT, OP and OD in the memory, and reset those registers so that OT equals T, OP equals P and OD equals D, as shown in logic blocks 76 and 77. Since no record is made of them, this effectively eliminates the pitch, time of commencement and duration of any pitches between that originally represented by OT, OP, OD and that originally represented by T, P, D, and replaces them with an absence of any pitch. If the pitch does equal the original pitch and the time of commencement, T, is close to the time OT plus OD, the CPU 6 resets the value of OD to equal T minus OT plus D, as shown in logic block 78. This extends the duration of OP, leaving only OP playing from the time it originally commenced to the time P originally ceased. After resetting OD as shown in logic block 78 or resetting OT, OP and OD as shown in logic block 77, as the case may be, the CPU 6 checks to see if the song has ended in logic block 80. If the song is not over, it inputs the next values for P, T and D, and repeats the entire comparison and output or modification process, with the new values of P, T, D, OP, OT and OD. If the song is over, the CPU 6 outputs the last values of OT, OP and OD as shown in logic block 81, and is through with the process of eliminating transients.

Figure 10:
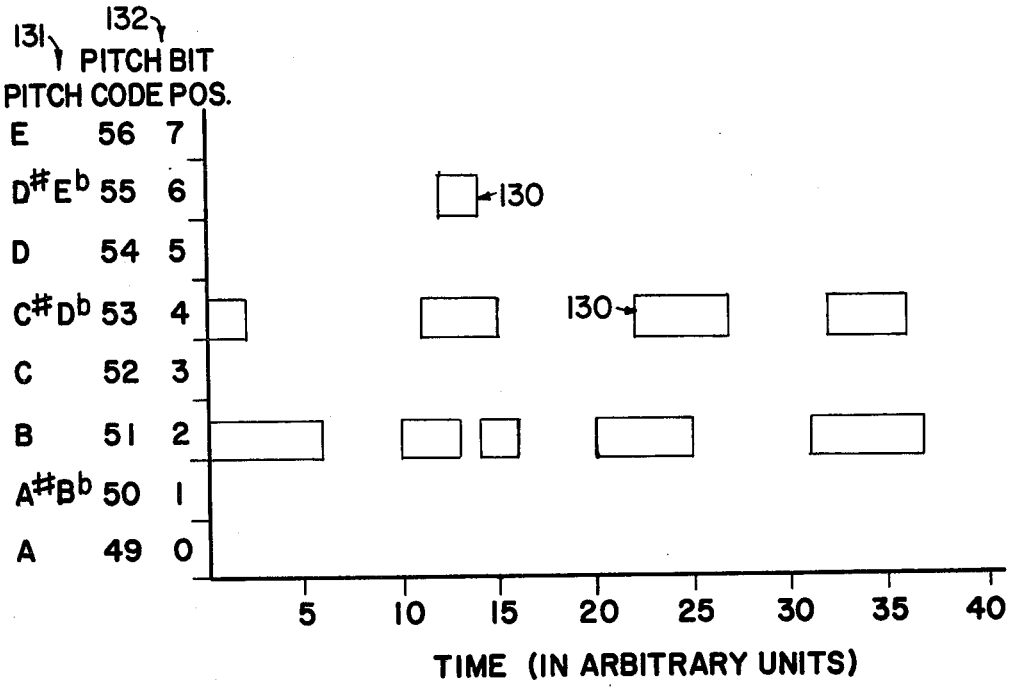
FIG. 10, sheet 8, is graphical representation of the data as it would be stored in the first instance.

Further understanding of this portion of the present invention may be had by reference to FIGS. 10 through 13, which graphically demonstrate the effects of the operations just described. FIG. 10, sheet 8, represents the data as originally stored in the memory. Time is in arbitrary units and each block 130 in the diagram represents a frequency or pitch which is being played at that particular time. The actual pitch is shown in the column 131 labeled pitch and the code representing that pitch in the column 132 labeled pitch code.

Figure 11:
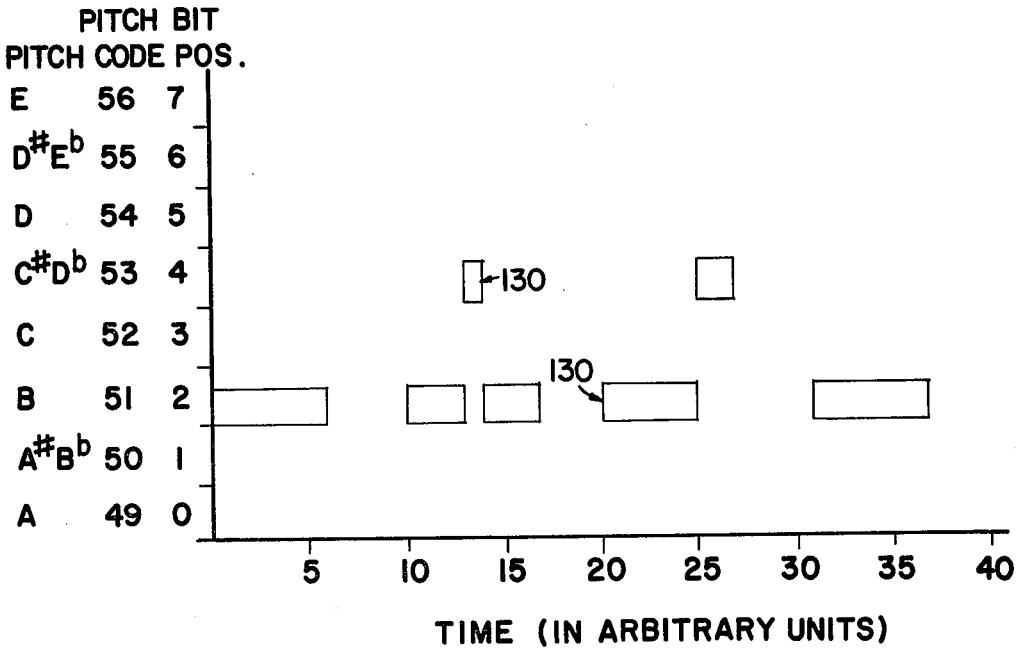
FIG. 11, sheet 8, is a graphical representation of the data after the harmonics have been removed.

FIG. 11, sheet 8, shows the effects of harmonic removal. A comparison with FIG. 10 will show that only the blocks 130 representing the lowest frequency playing at any particular time remain.

Figure 12:
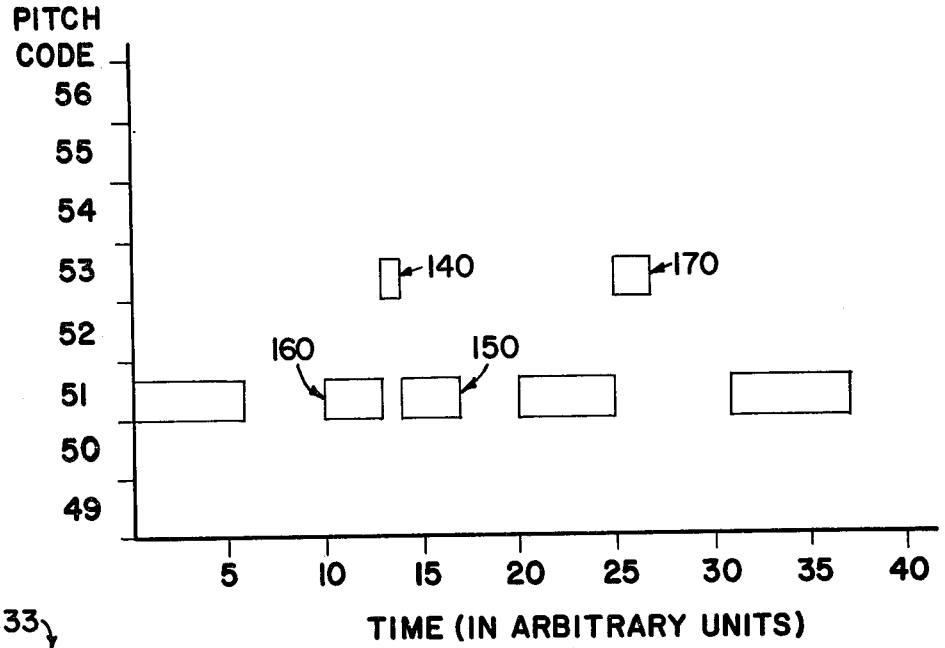
FIG. 12, sheet 9, is a graphical representation of the data after the duration of each particular pitch has been determined.

FIG. 12, sheet 9, shows the effects of data conversion. These effects are found primarily in the labeling at the bottom of the graph. Each bar on the graph now has at its beginning a number representing its pitch in the row 133 labeled pitch, a number representing its time of commencement in the row 134 labeled time and a number representing its duration in the row 135 labeled duration.

Figure 13:
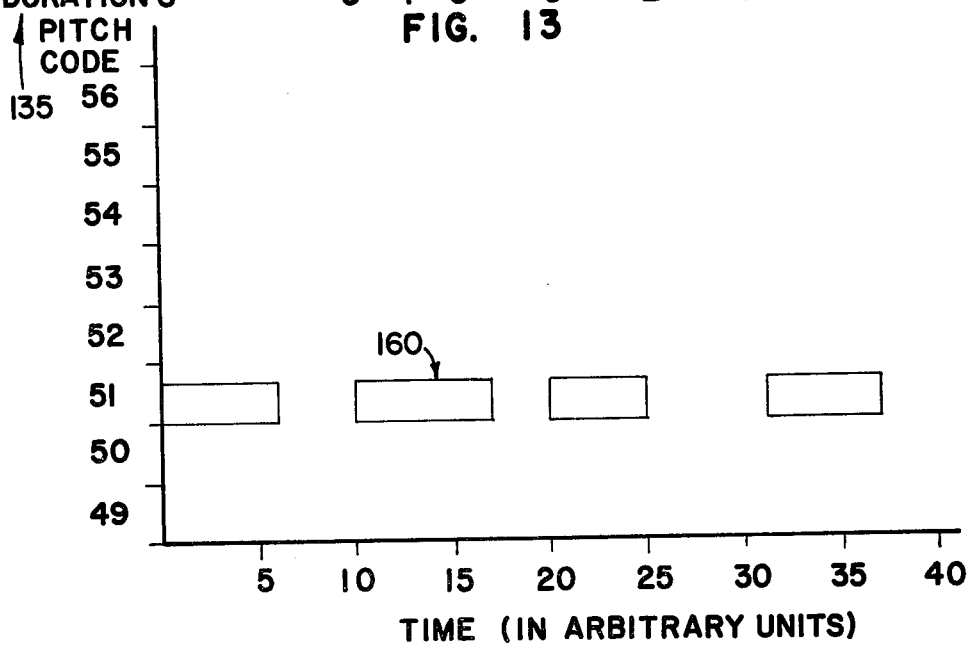
FIG. 13, sheet 9, is a graphical representation of the data after the transients have been eliminated.

FIG. 13, sheet 9, shows the effects of transient elimination. Comparing FIG. 13 to FIG. 12, it will be seen that transients 140 which were followed within a certain length of time by the same pitch 150 as immediately preceded them 160 have been eliminated, as have the pitches, times of commencement and duration of the pitches 150 which promptly followed those transients 140. In their places, the duration of each pitch 160 immediately preceding the transient 140 has been increased so that the single pitch will sound continuously from the time the pitch 160 immediately preceding the transient 140 originally began to the time the pitch 150 promptly following the transient originally ended. Transients 170 which were not promptly followed by the same pitch as immediately preceded them have been eliminated and replaced by blanks. The numbers shown below the graph also reflect these changes.

Figure 8:
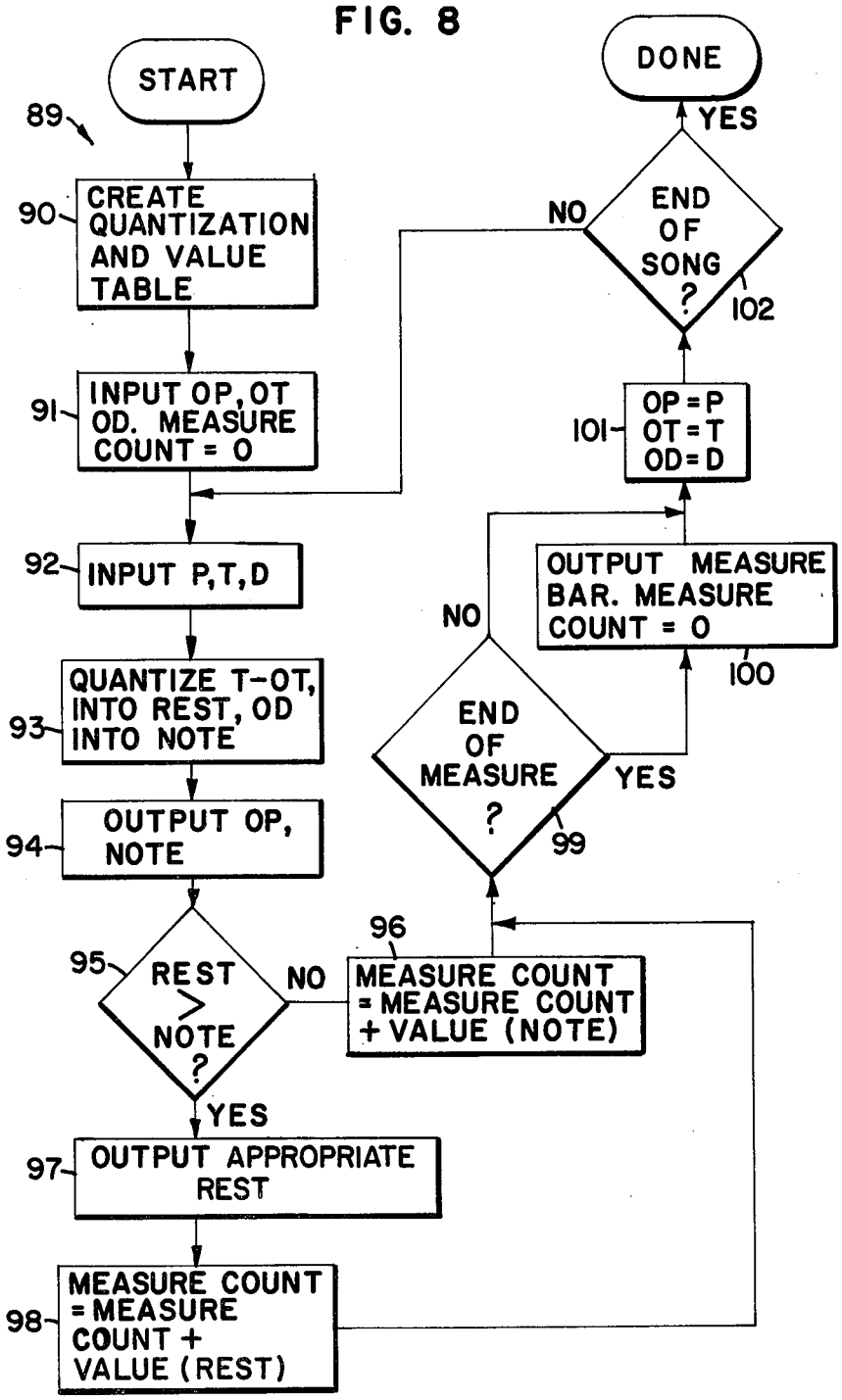
FIG. 8, sheet 6, is a detailed flow chart showing the procedure for determining what notes and rests are appropriate to represent a particular pitch or pause.

The procedure for the time signature analysis which generates the note and rest data is laid out in the flow chart 89 shown in FIG. 8, sheet 6. The CPU 6 starts in logic block 90 by creating a quantization and value table, which contains the time durations of each conventional note and rest. Next, in logic block 91, the CPU 6 inputs the first values of the pitch, time of commencement and duration as OP, OT and OD, respectively. It also creates a register labeled MEASURE COUNT, which represents the number of beats in the measure which have elapsed, and sets it to zero. Going to logic block 92, the CPU 6 inputs the next values for the pitch, time of commencement and duration as P, T and D, respectively. In logic block 93, the CPU 6 sets a register REST equal to the value in the quantization and value table closest to T minus OT. It sets a register NOTE equal to the value in the quantization and value table closest to OD. In logic block 94, it stores OP and the appropriate note value in the memory 7. Taken together, OP and the note value represent the pitch and the note of proper duration to represent the pitch as it occurred in the song. Going to logic block 95, the CPU 6 compares the values of REST and NOTE. If REST is not greater than NOTE, the CPU 6 sets MEASURE COUNT to the previous value of MEASURE COUNT plus the value of NOTE. If REST is greater than NOTE, the CPU 6 determines and stores in the memory 7 the appropriate rest or rests to represent the value of REST minus NOTE. It chooses the rest or rests from a quantization and value table in the same fashion as it did for NOTE. The CPU 6 then sets the value of MEASURE COUNT to the previous value of MEASURE COUNT plus the value of REST. Whether REST was greater than NOTE or not, once the CPU 6 has reset the value of MEASURE COUNT, it checks to see whether it has reached the end of the measure. If it has, it stores a measure bar in the memory 7 and resets MEASURE COUNT to zero. If it is not the end of the measure, or after the measure bar has been stored, the CPU 6 sets OP, OT and OD equal to the old values of P, T and D, respectively, as shown in logic block 101. In logic block 102, the CPU 6 checks to see if it has reached the end of the song. If it has not, it inputs the next values of pitch, time of commencement and duration as P, T and D, respectively, and goes through the entire quantization and comparison process again. If it is the end of the song, the time signature analysis is complete.

Figure 9:
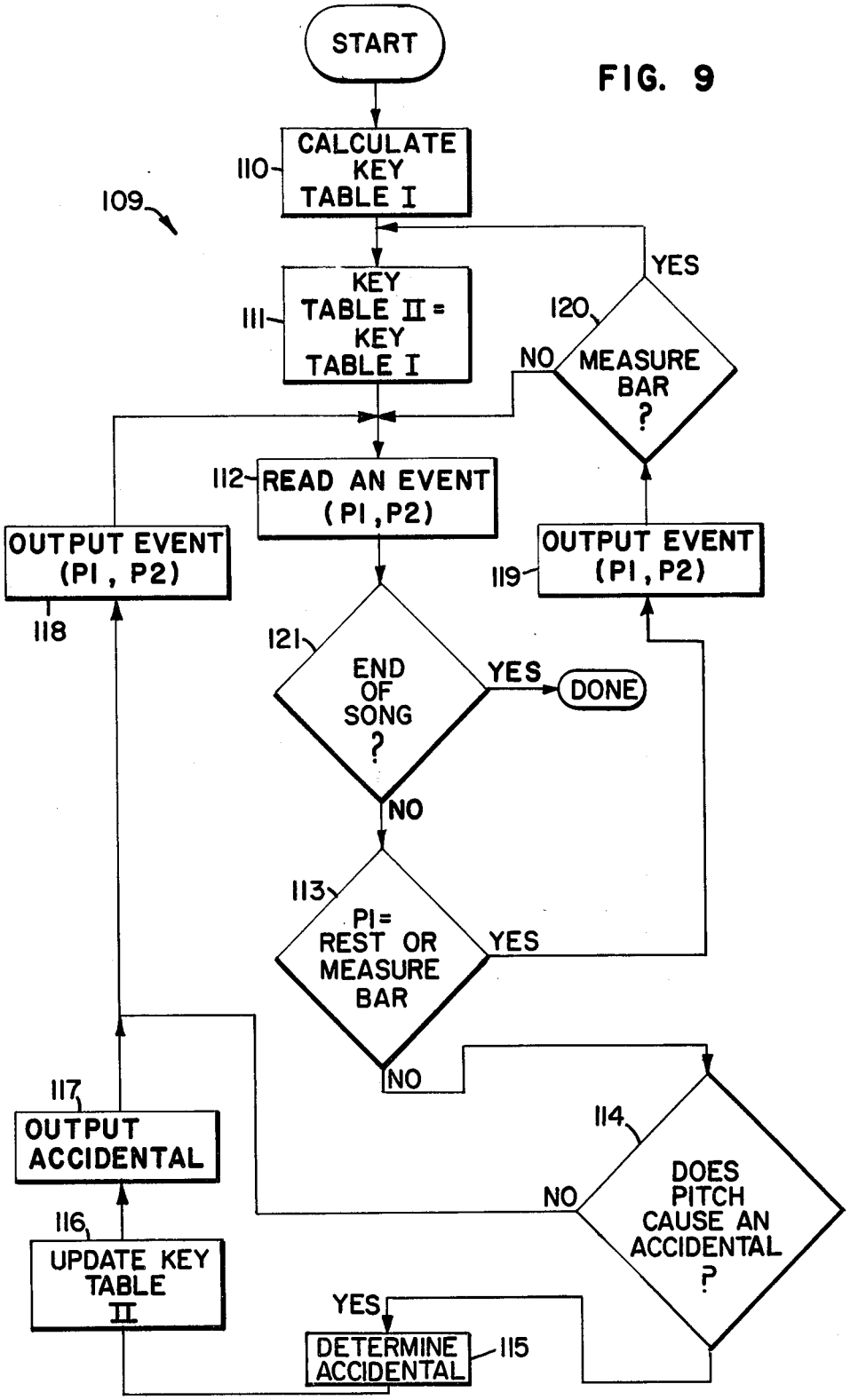
FIG. 9, sheet 7, is a detailed flow chart showing the procedure for determining whether a particular note must be accompanied by an accidental sign to be properly represented on a conventional music score.

The key signature analysis, in which the need for accidental signs is determined, is layed out in the flow chart 109 shown in FIG. 9, sheet 7. The CPU 6 begins by calculating a key table. FIG. 18, sheet 3, shows the key tables for the keys of G, D, A, E and B. FIG. 19, sheet 3, shows the key tables for the keys of F, B flat, E flat, A flat, D flat and G flat. For convenience, an octave, beginning with the letter which is the name of the key, has been immediately preceded by a horizontal bar and immediately followed by a horizontal bar in both of these tables. The key signature table for the key of C is shown in FIG. 20, sheet 1. The table in FIG. 19 also represents the keys of A sharp, D sharp, G sharp, C sharp and F sharp, since the key of B flat has the same notes as the key of A sharp, E flat as D sharp, A flat as G sharp, D flat as C sharp and G flat as F sharp, the same codes represent those keys. In these key signature tables, the presence of a particular pitch or frequency in a key is indicated by the number 1. The absence of a particular pitch or frequency from the key is indicated by the number 0. While the tables shown are only for the major keys, similar tables may be generated for the minor keys or any other mode simply by using a 1 to represent a note in the key and a 0 to represent the absence of a note. Key table I, created in logic block 110 in FIG. 9, is the table representing the key in which the song is written. In logic block 111, the CPU 6 generates key table II. This table represents the notes in the key at any particular point in a measure according to the conventional usages for the effects of accidental signs on what a note in a particular position on a score represents. Key table II is initially the same as key table I and will be reset to equal key table I at the beginning of each measure.

After having generated key tables I and II, the CPU 6 reads an event from the memory in logic block 112. Each event has two pieces of information, P1 and P2. P1 is a note, rest or measure bar and P2 is the pitch of the note if P1 is a note. The CPU 6 next checks to see if the particular event it has just read is the end of the song. As shown in logic block 121, if it is the end of the song, the key signature analysis is complete. If it is not the end of the song, the CPU 6 goes on in logic block 113 to check to see if P1 is a rest or measure bar. If it is not, P1 must be a note and the CPU 6 checks in logic block 114 to see whether the pitch represented by P2 causes an accidental. If it does, the CPU 6 goes on in logic block 115 to determine the appropriate accidental which should accompany that pitch, in logic block 116 to change key sign table II so that it properly reflects the effect of the accidental, and in logic block 117 to store the accidental in the memory 7. In the event the pitch does not cause an accidental, or after having outputted the accidental if it does, the CPU 6 stores the event, P1 and P2, in the memory 7 in logic block 118. The CPU 6 then goes back to logic block 112 and reads in the next event. In the event that P1 is not a note, but a rest or measure bar, the CPU 6 stores the event, P1 and P2, in the memory 7 in logic block box 119. It then checks in logic block 120 to see whether P1 is a measure bar. If it is, the CPU 6 goes back to logic block 111 and again sets key sign table II equal to key sign table I. From there it goes to logic block 112, reads in the next event and continues. If P2 is not a measure bar, the CPU 6 goes directly to logic box 112 to read in the next event and continue the analysis.

If desired, the music may be readily transposed to a different key by the addition of a few steps, not shown, before logic box 121. First, the key table for the key into which the piece is to be transposed rather than the key in which the piece is played is used for key table I. Second, the number of notes between the key in which the music was played and the key in which it is to be transcribed is determined. This number is then added to the value of P2 and substituted therefor. Other than this the key signature analysis remains the same.

Figure 15:
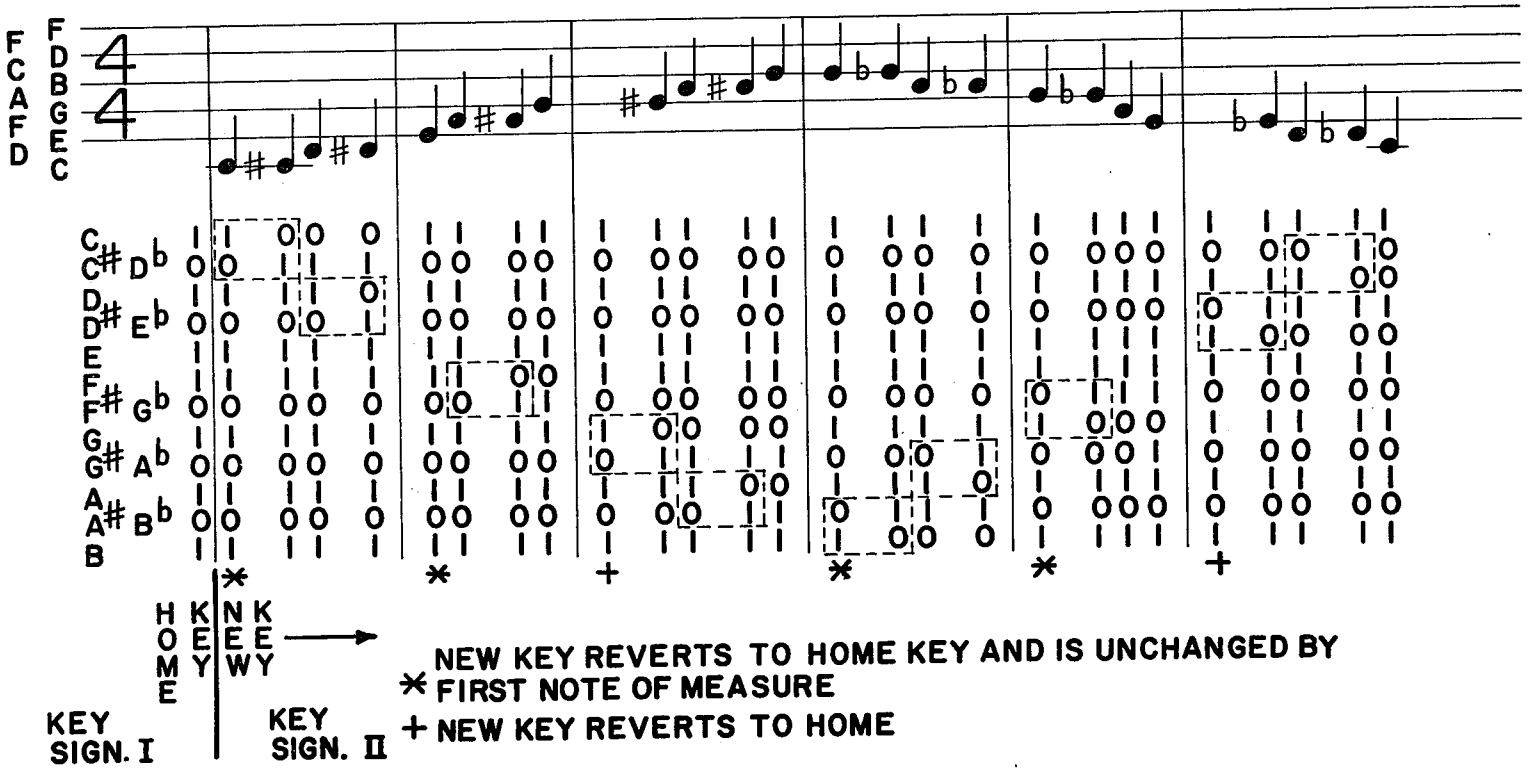
FIG. 15, sheet 11, is a graphical example of the key signature analysis for the key of C.
Figure 16:
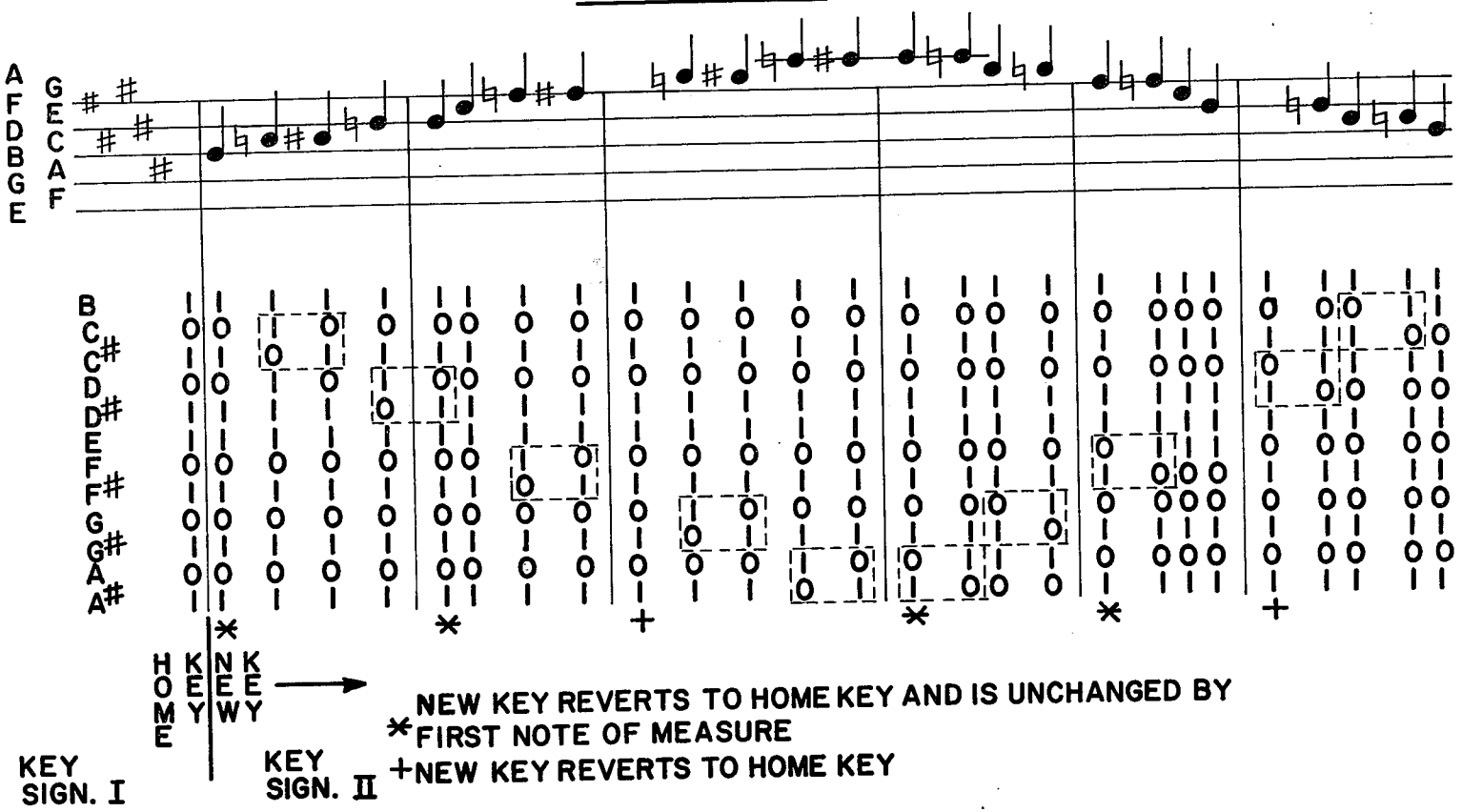
FIG. 16, sheet 12, is a graphical example of the key signature analysis for the key of B.
Figure 17:
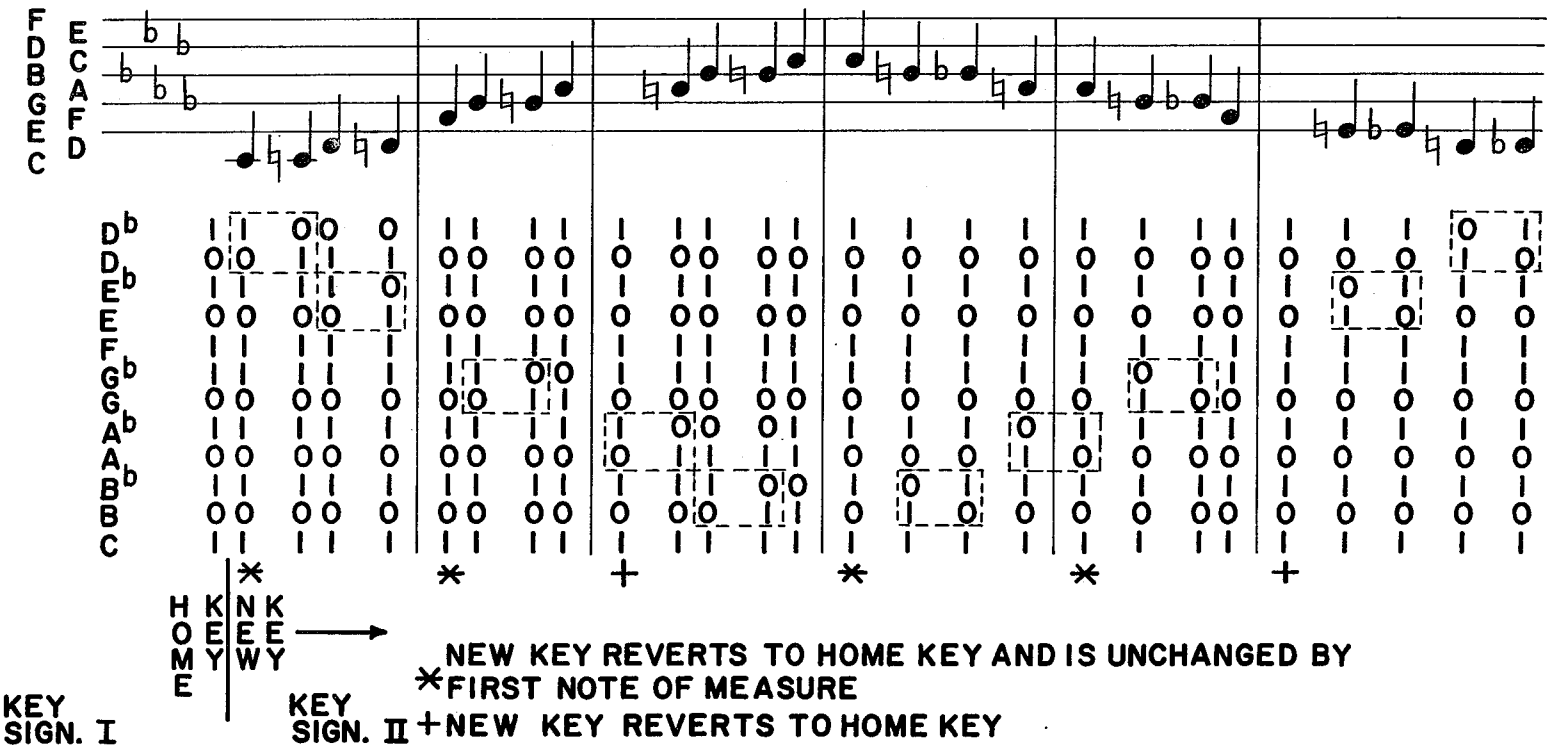
FIG. 17, sheet 13, is a graphical example of the key signature analysis for the key of B flat.

FIG. 15, sheet 11, FIG. 16, sheet 12 and FIG. 17, sheet 13, show examples of the operation of the key signature analysis in the keys of C, B and B flat, respectively. The items surrounded by dotted lines show the changes in key sign table II caused by the presence of an accidental. As may be seen, key sign table II reverts to the home key at the beginning of each measure.

Figure 14:
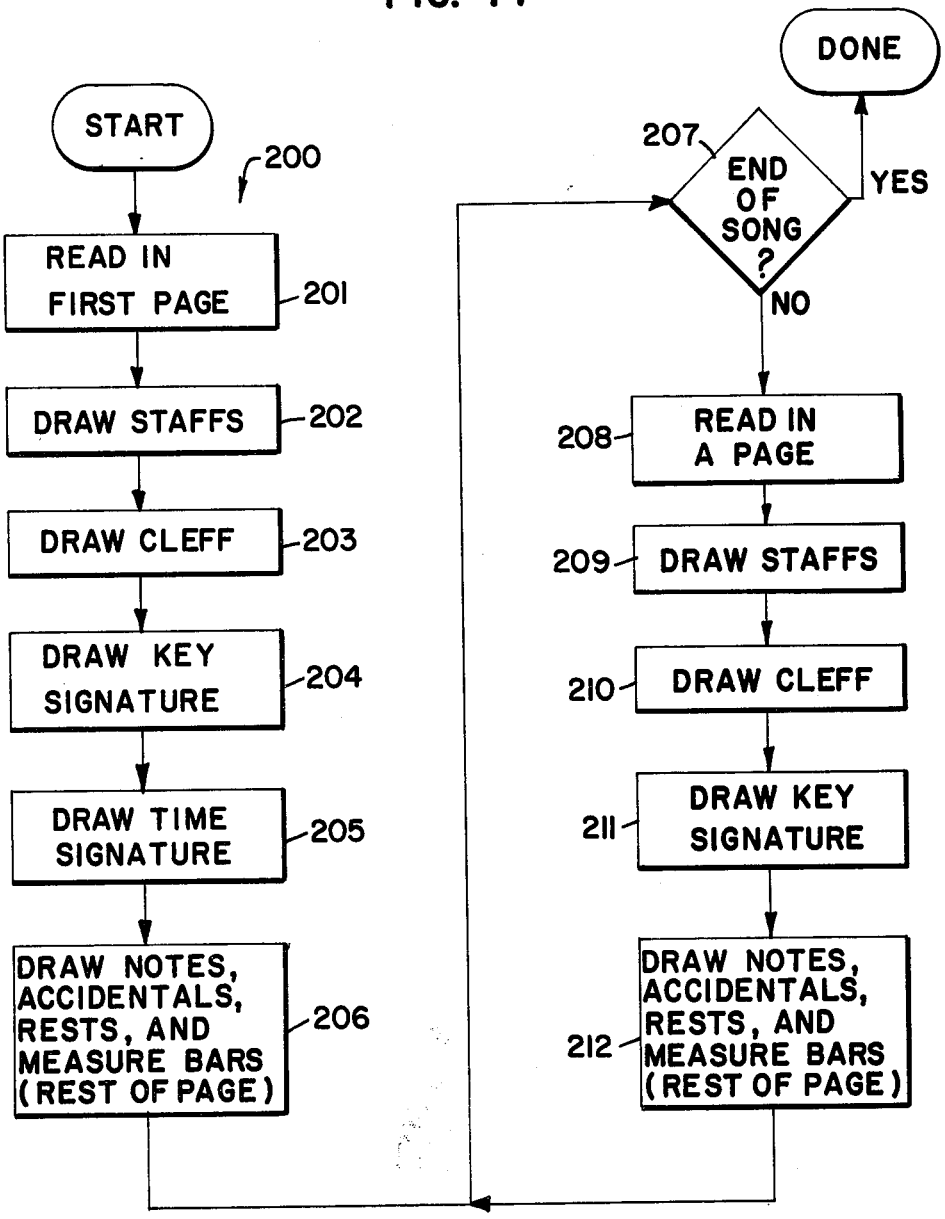
FIG. 14, sheet 10, is a detailed flow chart of the procedure for displaying the transcription.

As shown by the flow chart 200 in FIG. 14, sheet 10, after the data is processed, it is displayed on the display device by reading in the first page of music in logic box 201, drawing the appropriate staffs, clefs, key signatures and time signatures in logic boxes 202 to 205, respectively, and then drawing the notes, accidentals, rests and measure bars in logic box 206. If the song has not ended, the next page is read in logic box 208 and the process is repeated, except for printing of the time signature, in logic boxes 208 to 212. Once the song has ended, the music transcription is complete.

While the invention has been particularly shown and described with reference to a preferred embodiment thereof, it will be understood that those skilled in the art may make changes in the form and details of the preferred embodiment without departing from the spirit and scope of the invention.

What is claimed is:

1. A music transcription apparatus comprising:

input means for receiving an analog electrical signal representative of musical sounds;

detector means for determining the component pitches and pauses of said analog signal;

timing means for measuring the time at which each pitch or pause in said analog signal commences and its subsequent duration;

memory means for storing as basic data codes indicative of the component pitches and pauses of said analog signal, their respective times of commencement and their durations;

harmonic removal means for eliminating from said basic data all pitches, along with their respective times of commencement and durations, other than the lowest pitch playing at each particular time;

transient removal means for removing from said basic data each transient pitch or pause which is promptly followed by a pitch which is the same as the pitch immediately preceding said transient pitch or pause, for removing said promptly following pitch and for extending the duration of said immediately preceding pitch so that said pitch will play continuously from the time said immediately preceding pitch originally commenced to the time said promptly following pitch originally ceased, and for replacing all other transient pitches with pauses;

time signature analysis means for generating note and rest data by determining the note or rest of a time duration and position on a conventional music score to properly represent each occurrence of each pitch or pause in the basic data as modified by the harmonic removal means and the transient removal means;

key signature analysis means for generating accidental sign data by determining whether each note in the note and rest data should be preceded by an accidental sign to be properly represented on a conventional music score; and display means for displaying the note and rest data and the accidental sign data on a conventional music score, thereby generating a transcription of said musical sounds.

2. A music transcription apparatus according to claim 1 further comprising a microphone for generating said analog signal by generating an analog electrical signal representative of the variation in air pressure around said microphone.

3. A music transcription apparatus according to claim 1 further comprising a device for generating said analog signal by playing back a previously recorded analog signal representative of musical sounds.

4. A music transcription apparatus according to claim 1 wherein said detector means comprises a bank of electronic detectors, each detector being sensitive to a particular pitch and generating a signal only when it is receiving the particular pitch.

5. A music transcription apparatus according to claim 1 wherein the timing means, memory means, harmonic removal means, transient removal means, time signature analysis means and key signature analysis means further comprise an electronic data processing system.

6. A music transcription apparatus comprising:

input means for receiving an analog electrical signal representative of musical sounds;

an array of electronic frequency detectors for receiving said analog signal, determining its component frequencies and producing a digital signal indicating which frequencies are being received at each moment;

a timer for generating timing pulses at a particular interval;

a memory device capable of receiving, storing and recalling information;

signal processing and analysis means for receiving said digital signal and time pulses; for counting said time pulses; for storing in said memory device, each time said means receives a time pulse, a code representative of the digital signal said means is then receiving and the number of time pulses which have then elapsed since said means started storing said codes; for deleting from storage in said memory device each code representing a frequency which occurred at the same time as another lower frequency; for converting said codes as modified to a new format by determining and storing in said memory device converted codes indicative of each remaining frequency or absence of any frequency, the time at which each such frequency or absence of frequency commenced and their respective durations; for deleting from said converted codes each transient frequency or absence of any frequency which is promptly followed by the same frequency as immediately preceded it; for extending the duration of said immediately preceding frequency so that it will occur continuously until the time said promptly following frequency ceases; for deleting said promptly following frequency; for deleting all other transient frequencies and replacing them with absences of frequency; for determining and storing in the memory device the proper notes, rests and accidental signs to represent on a conventional music score each frequency or absence of frequency represented by the thus modified converted codes; and a display device for displaying the notes, rests and accidental signs stored in the memory device, said notes, rests and accidental signs being so arranged and displayed on a conventional music score as to properly represent said musical sounds.

7. A music transcription apparatus according to claim 6 further comprising a microphone for generating said analog signal by generating an analog electrical signal representative of the variation in air pressure around said microphone.

8. A music transcription apparatus according to claim 6 further comprising a device for generating said analog signal by playing back a previously recorded analog signal representative of musical sounds.

9. A process for transcribing music by use of a data processing system, the process comprising:

receiving an analog electronic signal representative of musical sound;

creating a digital signal representative of the component frequencies contained in said analog signal;

deleting from said digital signal representations of every frequency other than the lowest frequency occurring at each point in time;

storing data representing each of said lowest frequencies, their respective times of commencement and time durations;

deleting from said stored data each frequency or absence of any frequency which has a duration less than a particular duration and is immediately preceded by the same frequency as follows said frequency or absence of frequency within a particular time;

changing the duration of said immediately preceding frequency indicated in said stored data so that said immediately preceding frequency is shown as enduring continuously until the time said following frequency ceases;

deleting from said stored data said following frequency;

deleting from said stored data each remaining frequency having a duration less than said particular duration and substituting therefore an absence of any frequency;

comparing said stored data as modified to a table of note durations and pitches to determine the appropriate note to represent each frequency in said stored data comparing said stored data to a table of rest durations to determine the appropriate rest to represent each absence of any frequency in said stored data;

comparing said notes to a key signature table to choose the accidental signs, if any, necessary to properly represent each of said notes on a conventional music score;

displaying the results of said comparisons on a conventional music score in a visual display, thus creating a transcript of said musical sound.

* * * * *